US006121949A

United States Patent [19]

Ramamurthy et al.

[11] Patent Number: 6,121,949

[45] **Date of Patent: *Sep. 19, 2000**

[54] METHOD AND APPARATUS FOR AUTOMATICALLY MAINTAINING A PREDETERMINED IMAGE QUALITY IN A DISPLAY SYSTEM

[75] Inventors: Sriram Ramamurthy, Fremont; Dayakar C. Reddy; Modugu V. Reddy, both of San Jose, all of Calif.

[73] Assignee: Cirrus Logic, Inc.

[ * ] Notice: This patent issued on a continued prosecution application filed under 37 CFR 1.53(d), and is subject to the twenty year patent term provisions of 35 U.S.C. 154(a)(2).

[21] Appl. No.: 08/382,355

[22] Filed: Feb. 1, 1995

Related U.S. Application Data

[63] Continuation-in-part of application No. 08/214,370, Mar. 17, 1994, abandoned.

[51] Int. Cl.[7] ..... G09G 3/36

[52] U.S. Cl. ..... 345/101; 345/117; 345/214

[58] Field of Search ..... 345/101, 3, 117, 345/200, 212, 112, 213, 214; 364/900; 395/430; 340/825.21

[56] References Cited

U.S. PATENT DOCUMENTS

| | | | |
|---|---|---|---|
| 4,165,506 | 8/1979 | Brands et al. | 345/200 |
| 4,815,026 | 3/1989 | Barbu et al. | 364/900 |
| 5,027,111 | 6/1991 | Davis et al. | 345/101 |
| 5,029,982 | 7/1991 | Nash | 345/101 |
| 5,088,806 | 2/1992 | McCartney et al. | 345/101 |
| 5,159,683 | 10/1992 | Lvovsky et al. | 345/3 |
| 5,398,042 | 3/1995 | Hughes | 345/101 |
| 5,489,918 | 2/1996 | Mosier | 345/101 |
| 5,513,334 | 4/1996 | Alexander | 395/430 |
| 5,515,074 | 5/1996 | Yamamoto | 345/101 |
| 5,550,556 | 8/1996 | Wu | 345/213 |
| 5,559,502 | 9/1996 | Schutte | 340/825.21 |
| 5,574,475 | 11/1996 | Callahan, Jr. et al. | 345/100 |

*Primary Examiner*—Kent Chang
*Attorney, Agent, or Firm*—Robert Platt Bell

[57] ABSTRACT

A display system in a computer or multimedia system maintains a predetermined image quality. The display system includes an intelligent display driver controller (IDDC), a serial PROM, display screen, and sensors. The IDDC controls display of input image data on the display screen based on a control set. The serial PROM stores a plurality of such control sets, each of which has a predetermined effect on the image quality. The sensor measures a parameter, a change in which may degrade the image quality on the display screen. In response to such a change, the IDDC retrieves a new control set from the serial PROM, and controls display of input image data based on the new control set retrieved. As a result, the IDDC maintains the predetermined image quality on the display system independent of change in the measured parameter.

28 Claims, 7 Drawing Sheets

METHOD AND APPARATUS FOR AUTOMATICALLY MAINTAINING A PREDETERMINED IMAGE QUALITY IN A DISPLAY SYSTEM

CROSS REFERENCE TO RELATED APPLICATION

This application is a continuation-in-part of application titled "METHOD AND APPARATUS FOR AUTOMATICALLY MAINTAINING A PREDETERMINED IMAGE QUALITY IN A DISPLAY SYSTEM", application Ser. No. 08/214,370, filed on Mar. 17, 1994, now abandoned.

FIELD OF THE INVENTION

This invention relates to the field of on-board display driver controllers. More particularly, this invention relates to a system for providing non-display signals or control data to the on-board display driver controller during the display period.

BACKGROUND OF THE INVENTION

FIG. 1 shows a block diagram of a conventional digital system such as a computer or multimedia system 150 which includes a graphics controller 126 that can support a panel display 132 or an external cathode ray tube (CRT) display 103. It is understood that a typical digital system will usually only include a single display device. However, it is possible to include more than one display device in a single system, wherein all of the display devices are supported by the graphics controller 126.

In the computer or multimedia system 150 illustrated in FIG. 1, a main control printed circuit board 120, commonly known as the 'motherboard', includes, among other devices, a central processing unit (CPU) 122 that is coupled to an address/data bus 124.

A graphics controller 126, such as a VGA controller, is also coupled to the bus 124. Once the graphics controller 126 has processed the information necessary for forming an image, the information is coupled to a display bus 128 and then to a first cable connector 130 which in turn is coupled to a cable 134.

The motherboard 120 is coupled to the display system 132 via the standard cable 134. The standard cable 134 may include a plurality of pixel data signal lines. Standard cables 134 typically include 3, 4, 6, 8, 9, 12, 15, 16, 18 or 24 pixel data signal lines. Multiple standard cables 134 may be coupled between the motherboard 120 and the display system 132, each having N pixel data signal lines, allowing more pixels to be carried across the cable at one time. Other control signal lines including lines for vertical sync, horizontal sync, pixel clock and data enable lines may be included within the standard cable 134 as well. Power and ground lines may also be included within the standard cable 134. If the display system 132 is not attached to the computer or multimedia system 150, the power supply lines may be provided separately to the panel display or by a self contained battery source.

Exemplary control signal lines within the display system 132 are designated as the lines 152, 153 and 154. The standard cable 134 is coupled to the display system 132 via a second cable connector 136. The information received at the cable connector 136 is coupled to the row driver devices (RD1–RDn) 105A–105N (105X) as well as the column driver devices (CD1–CDn) 142A–142N (142X) of the panel display 132. Through the pixel data bus 144, the pixel data is properly sent to each column driver 142X as each row is scanned via row drivers 105X. Techniques of how various panels are scanned are well known in the art and will not be further explained herein. An exemplary display system updates the screen information once every 16 milliseconds. One entire screen image is conventionally called a frame.

An optional CRT display 103 can be coupled external to the computer or multimedia system 150. The CRT display 103 is coupled to the computer or multimedia system 150 and motherboard 120 through a first connector 101, a cable 164, and a second connector 104. The graphics controller 126 generates and drives the analog RGB or digital pixel signals to the CRT display 103 via the bus 123. The analog RGB or digital pixel signals are received across the cable 164 by a CRT driver board 106 which drives the CRT electron guns 107 via a cable 121. The cable 164 may be one of a plurality of cable types having appropriate connectors 101 and 104 to transmit data from the motherboard 120 to the CRT display 103.

In a conventional color display system, the image data necessary to display a single pixel may include 24 bits total, 8 bits each for red, green, and blue. Alternatively, 18 bits total may be used including 6 bits each for the colors red, green and blue as well as other numbers defining a pixel data word including monochrome pixel data words. Video memory 172 is loaded with the data necessary for the graphics controller 126 to instruct the panel display 132 to draw each pixel. Presently, a pixel data word may be sent over the standard cable 134 one pixel at a time in parallel groups of 24 bits or 18 bits, as the case may be, onto pixel data bus 144. Future systems may transfer more than one pixel data word at a time across the standard cable 134, using multiple cables, such that two or more pixels will be transmitted simultaneously.

The column drivers 142X and row drivers 105X are configured to excite predetermined portions of a display screen in one of several known ways. The panel 112 can be a passive matrix LCD display, active matrix LCD display or other type of panel. Optionally, a CRT display 103 may be driven alone by the graphics controller 126, as part of a desk-top computer, or simultaneously with the panel display 132 that may be a part of a computer or multimedia system 150. Depending upon the type of display screen being used, appropriate display circuits will be selected. It should be apparent to one of ordinary skill in the art how the column driver circuits 142X and row driver circuits 105X are activated to excite the entire array of pixels within the panel 112 to form a complete image.

As display technology has progressed, skilled practitioners have learned that the quality of a displayed image can change with a variety of parameters including temperature, display voltage linearity and intrinsic properties of the display screen. Because responses to variations in these and other such parameters are known, a system can be optimized to operate for a predetermined known parameter set. Unfortunately, these parameters can change over periods of time as well as environmental conditions. For example, as the time of day changes, the operating temperature of a display system may change. For a computer or multimedia system, the power supply voltage can sag as the battery charge decays between charging periods. It is desirable to compensate for poor image quality of the display, that may be caused by a change in these panel parameters.

Due to market conditions, it is desirable to keep the interface architecture between a CPU and a display fixed as much as possible. It is also desirable to keep the software that controls the interface fixed as much as possible. It is particularly desirable to keep the graphics controller integrated circuit 126 and the video bios fixed, yet improve the controllability of the panel display 132 and the CRT display 103. Typical customers and applications demand that the various components of a personal computer such as a so-called "IBM PC clone" be plug compatible. In other words, changes to the equipment provided by one manufacturer which make a product no longer compatible with equipment manufactured by others, will not readily gain market acceptance. It is therefore desirable to maintain compatibility in the hardware components of a system. For example, it is desirable that any compatible display 132 may be coupled to the motherboard 120 by a standard cable 134.

It is desirable that a display system be manually or automatically modified such that the display image can be improved as operating conditions change. It is further desirable that a system designed to provide these advantages, be compatible with existing software and hardware components such that few changes are required to the existing interface architecture. In addition, it is desirable to require minimal additional space, and to decrease or eliminate additional costs in meeting these objectives.

SUMMARY OF THE INVENTION

A digital system includes a CPU that is coupled to a display controller which in turn is coupled to a display system via a cable. The display system includes an intelligent display driver controller (IDDC), a plurality of driver circuits and a display screen. The intelligent display driver controller receives instructions and input data (display information) from the display controller over the cable. The intelligent display driver controller operates on input data, transforms the input data based on current conditions and provides appropriate instructions to appropriate ones of the plurality of driver circuits for forming an image on the display screen.

The display system may also include one or more transducers and/or sensors which measure operating conditions. Changes in the measured operating conditions will result in a degradation in display image quality unless a response is made. The digital system may be configured to automatically respond to changes in the measured operating conditions in order to maintain a predetermined level of image quality on the display screen. Alternatively a user may select, via operating system software or application software, that the screen parameters be updated to improve the quality of the display. In the case of software selection, no sensors may be necessary to sense changing environmental conditions.

Three techniques are taught for providing the control information to the display system. A first technique includes additional control signal lines and/or cables coupled between the display system and the CPU or graphics controller. Upon receiving an indication of a change in operating conditions, the display system will then transmit information regarding the new conditions to the CPU or graphics controller. In response, the CPU or graphics controller transmits a new set of information (hereinafter control set) over the additional signal lines to the intelligent display driver controller to enable it to transform display data to suit the changed conditions and in turn control the driver circuits suitably. In the preferred embodiment a control set includes approximately 2,000 bytes of control information.

A second technique includes a large PROM coupled to the intelligent display driver controller (IDDC) by means of a parallel bus. The PROM contains a plurality of control sets. Each control set provides the necessary information to allow the intelligent display driver controller to transform input data and control the driver circuits for a particular operating condition. The intelligent display driver controller retrieves an appropriate one of the control sets depending upon information received from transducers/sensors or from the user via software, and transforms the input data according to the retrieved control set so as to compensate for any deterioration in display quality resulting from the change in the operating conditions.

A third technique teaches the preferred embodiment in which the IDDC retrieves the appropriate control set from the PROM by using a serial protocol. Accordingly, the preferred embodiment comprises a serial PROM coupled to the IDDC by means of a serial data address (SDA) signal line and a serial clock (SCL) signal line. The IDDC sends a clocking signal to the serial PROM over the SCL line, and retrieves the control set according to a predetermined serial protocol. Because of the decreased number of communication signal lines between the serial PROM and the IDDC, the preferred embodiment requires less number of pins on the IDDC and the serial PROM chips. This results in decreased space requirements for routing and footprint of the serial PROM, simplified routing, and decreased manufacturing costs.

As the transmission of the desired control set is received and stored, the intelligent display driver controller appropriately transforms the pixel data and adjusts its control over the row and column driver circuits and the image quality is adjusted appropriately.

DETAILED DESCRIPTION OF THE PREFERRED EMBODIMENT

Figure 2:
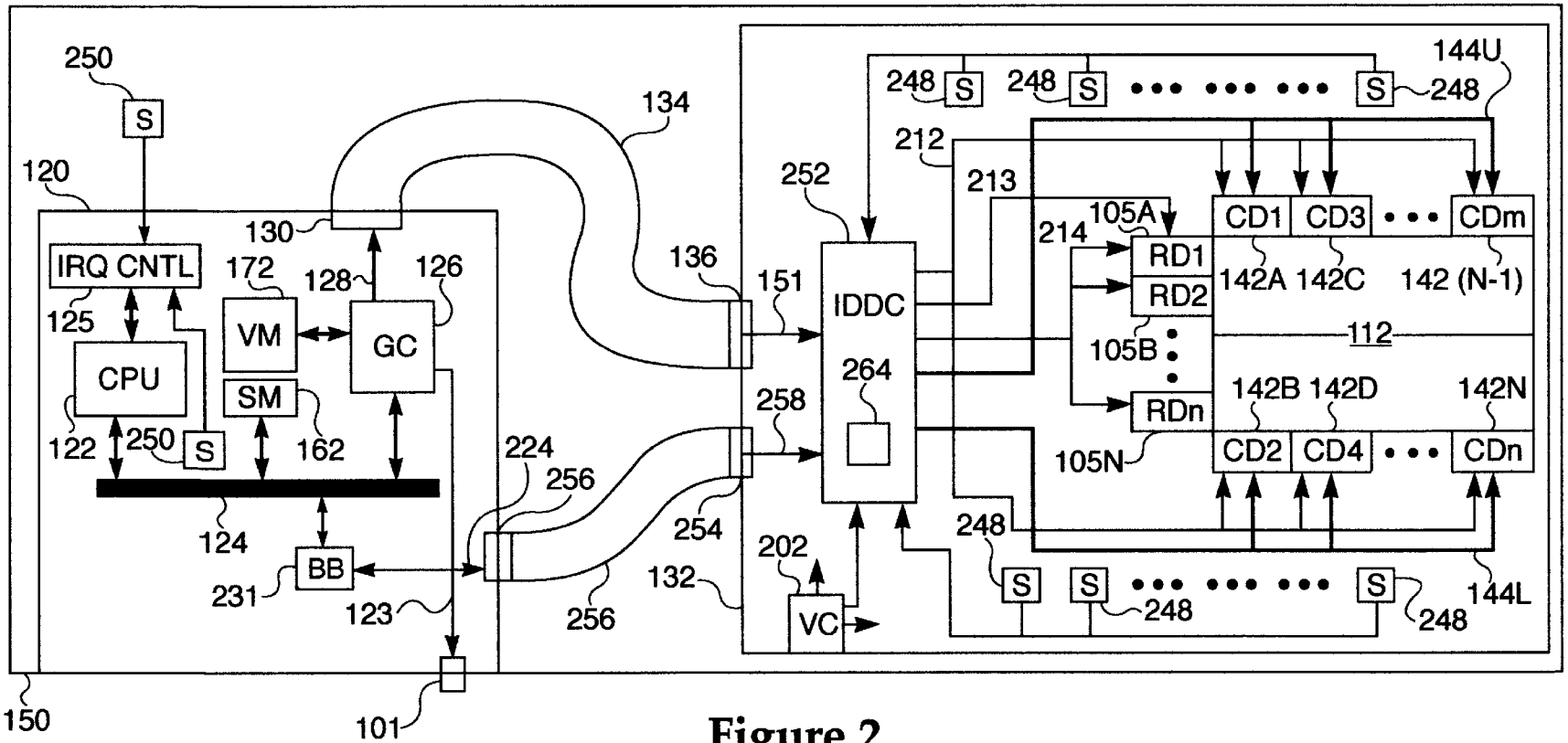
FIG. 2 is a block diagram of a first alternate embodiment of the present invention.

FIG. 2 shows a block diagram of a first embodiment of the present invention. Where appropriate to aid in understanding the various embodiments of the invention, those elements that are common to one or more of the various figures will be labeled with the same reference numerals. The system of the first embodiment includes a motherboard 120 having a CPU 122 coupled to an address/data bus 124 which is also coupled to a graphics controller 126. The graphics controller 126 is coupled to a display bus 128, to a first cable connector 130, a cable 134, a second cable connector 136 and to an intelligent display driver controller (IDDC) 252 via a first display bus 251. The IDDC 252 controls a plurality of column driver circuits 142X and row driver circuits 105X in a known manner.

One or more transducers and/or sensors 248 may be within the panel display 132 or within the CRT display 103 (FIG. 4A). The transducers/sensors 248 within the panel display may be coupled to the IDDC 252. The transducers and/or sensors 248 will be collectively referred to as Sensors 248 throughout the remainder of this document. Other transducers and /or sensors 250 on the motherboard 120 or within the computer or multimedia system 150 may be directly coupled to the CPU 122 via the interrupt controller 125. These transducers and/or sensors 250 will be collectively referred to as the sensors 250 throughout the remainder of this document. Other integrated transducers/sensors may be within various components on the motherboard 120, within computer or multimedia system 150, or within the panel display 132 or the CRT display 103. An exemplary integrated transducer/sensor within a component of the system is the voltage converter 202 which may indicate a change in operating conditions. The Sensors 248 and 250, or integrated transducers/sensors measure or sense one or more parameters that can effect the image quality of the display such as temperature, voltage linearity or intrinsic characteristics of the display screen. An indicia that is representative of the value of the measured or sensed parameter is provided to the IDDC 252 by the Sensors 248 or integrated transducers/sensors such as within panel voltage converter 202. A control set storage 264 is included within the IDDC 252 for storing a control set. A control set includes the necessary information for transforming pixel data appropriately and providing appropriate control and data to the row 105X and column driver circuits 142X. Details of how the IDDC interfaces to the row and column drivers is provided in U.S. Pat. application Ser. No. 08/138,366 entitled "Signal Driver Circuit For Liquid Crystal Displays" filed by Callahan et al. on Oct. 18, 1993 which is incorporated herein by reference.

The IDDC 252 may be coupled to the CPU 122 via a secondary communication path including a second display bus 258, a third connector 254, a second cable 256, a fourth connector 260, a bus 224, a bus buffer 231, the address/data bus 124 and the CPU 122. The second cable 256 is coupled between the third connector 254 and the fourth connector 260. The fourth connector is coupled to the bus buffer 231 by the bus 224. The address/data bus 124 is coupled between the bus buffer 231 and the CPU 122. In the alternative, the cable 134 can be expanded to include all of the extra control signal lines that would otherwise be included in the cable 256. In the case when the cable 134 is expanded, the secondary communication to the CPU 122 may be accomplished through a modified graphics controller, over the extra control signal lines within the expanded cable, instead of using an extra cable such as cable 256. However, it is preferable that no modifications are made to the graphics controller, in which case the extra signal lines within the expanded cable may simply be routed to a buffer, such as bus buffer 231.

In the event that the indicia provided by the Sensors 248 or integrated sensor/transducers to the IDDC 252 change by more than a predetermined value, the IDDC 252 transmits a request to the CPU 122 via the secondary path. The CPU 122 can be configured by appropriate software programming to calculate a new control set for the IDDC 252. In the alternative, a plurality of new control sets can be stored in a system memory 162. In such a case, the CPU 122 interrogates system memory 162 and selects the appropriate new control set. Once the new control set is determined, either by calculation or selection, the new control set is communicated to the IDDC 252 via the secondary path and stored into the control set storage 264. The IDDC 252 drives pixel data onto 144U and 144L. Other timing control for the row 105X and column drivers 142X are provide by lines such as 212, 213, and 214. By so updating the control set storage 264, the image quality can be manipulated appropriately through means such as the pixel data sent onto the lines 144U and 144L or by modifications in the timing control lines 212, 213, and 214.

A primary disadvantage of using this first embodiment is that the interface architecture between the motherboard 120 and the display system 132 is not standard because of the secondary path for communication. In one case an extra cable 256 and buffer 231 is required. In another case, the graphics controller 126 may be modified in order to support the extra command signal lines and a much larger nonstandard cable having extra signal lines is required as well. Thus, this first embodiment would require many changes from the standard system hardware in order to properly support sending a control set to a display. Persons having ordinary skill in the art recognize that computer equipment and work-stations manufacturers require interchangeable components. Failure of this first embodiment to provide such interchangeability will cause such a system to have a limited proprietary market.

Figure 3:
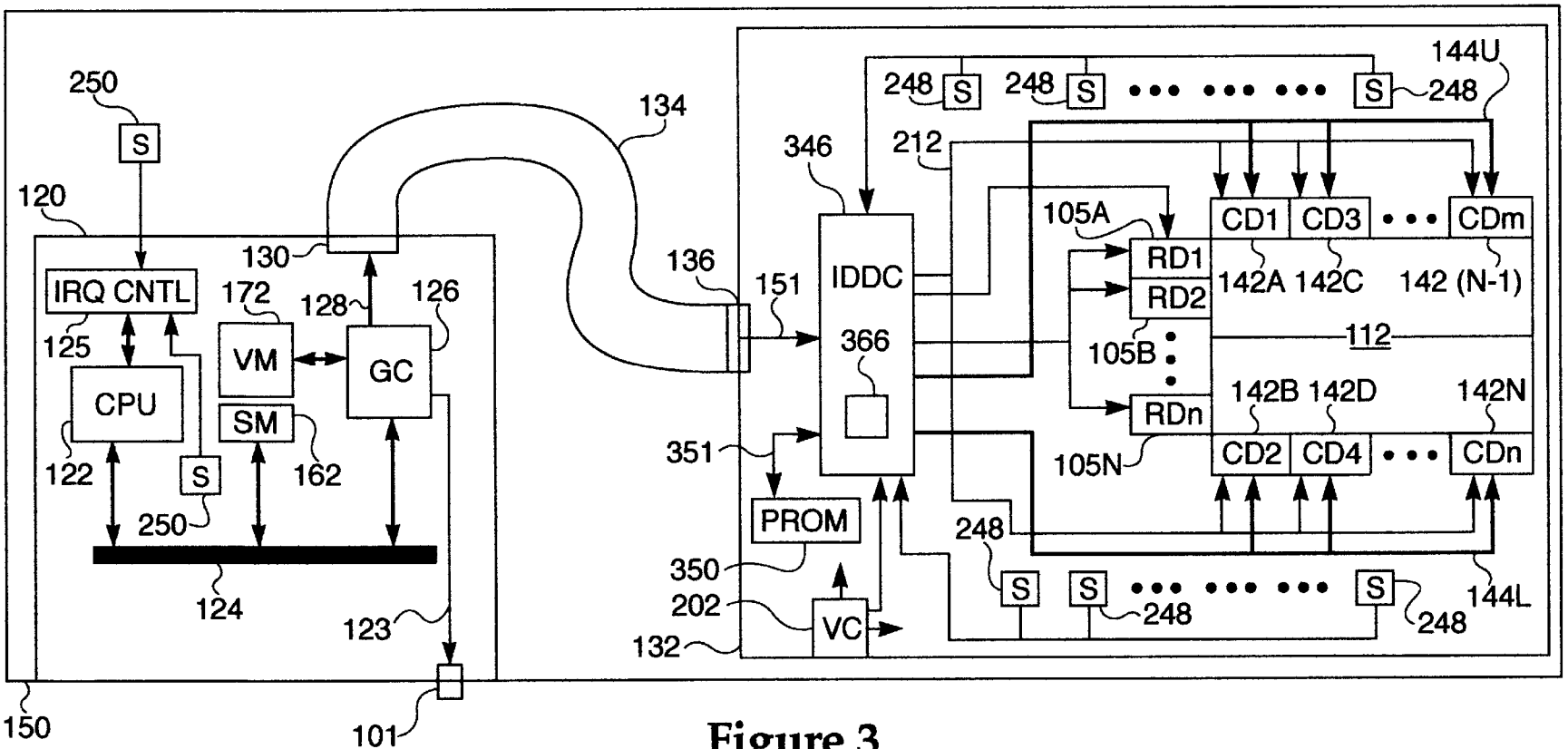
FIG. 3 is a block diagram of a second alternate embodiment of the present invention.

FIG. 3 shows a block diagram of a second embodiment of the present invention. The system of the second embodiment includes a motherboard 120 having a CPU 122 coupled to an address/data bus 124 which is also coupled to a graphics controller 126. The graphics controller 126 is coupled to a display bus 128, a first cable connector 130, a cable 134, a second cable connector 136 and to an intelligent display driver controller (IDDC) 346 via a first display bus 151. The IDDC 346 controls a plurality of row 105X driver circuits and a plurality of column driver circuits 142X in a known manner, such as described above. One or more transducers and/or sensors 248 and 250 and integrated transducers sensors, such as within the panel voltage converter 202, are coupled to the intelligent driver controller 346. The Sensors 248 and 250 or integrated transducers/sensors measure or sense one or more parameters that can effect the image quality of the display such as temperature, voltage linearity or intrinsic characteristics of the display screen. An indicia that is representative of the value of the measured or sensed parameter is provided to the IDDC 346 by the Sensors 248 or panel supply voltage 202.

A PROM 350 is coupled to IDDC 346 by means of a parallel bus 352 comprising a signal line for each of the address bits and the data bits to be transferred. Therefore, in a display system which uses a two-byte address and retrieves a byte of data during each clock cycle, the parallel bus 352 may include at least sixteen signal lines for transferring the address, eight signal lines for transferring the data, and two signal lines for sending control information.

The PROM 350 contains a plurality of control sets, each stored sequentially beginning from a corresponding predetermined starting address. Each control set provides the IDDC 346 with information sufficient to control the display drivers 142X and 105X depending upon the indicia provided to the IDDC 346 by the Sensors 248 or the panel voltage converter 202. In order to store the various control sets required, PROM 350 needs to be quite large. A small PROM (not shown) or memory space within PROM 350 can be utilized to store the initialization data for the IDDC 346.

Assuming operation under steady state measured or sensed parameter(s), the IDDC 346 accesses a predetermined address space within the PROM 350 for retrieving data necessary to control the display image quality at a particular level. The starting address for the address space within the PROM 350 can be held in a register of the IDDC 346. An address counter can be incremented from the register value as each new value is read to update the control set. Once the maximum count is reached, the counter is reset with the register value.

As the measured or sensed parameter(s) changes, the indicia provided to the IDDC 346 changes. Upon reaching a predetermined change in the indicia, a new starting address is computed within the IDDC 346 and a new address space within the PROM 350 is selected. The IDDC 346 increments through the new PROM address space to read the new control set into the control set storage 366 via the PROM address/data bus 351. In one case the new control set can be loaded immediately even though control set changes slightly modify the data displayed on the screen. Alternatively the new control set can be loaded during the non-display period (retrace) to effect the change in the next frame. Other wise the new control set could be loaded over a few frames in which case the display may have different levels of shading corrected and uncorrected for the changed environmental conditions.

Several basic alternatives to this technology will be apparent after reading this disclosure. For example, a person of ordinary skill in the art will recognize that the IDDC 346 can simply point to an appropriate address space within the PROM 350 and the pixel data can further select an address in order to read out proper display data from the PROM 350. Changing the control set simply requires changing the address space pointed to by the IDDC 346.

The memory holding the display sets must be programmable to accommodate the various display types that shall have different control set values. Thus, a disadvantage of this second embodiment is that programmable memories such as PROM, EPROM, and EEPROM semiconductor processing are more expensive than conventional MOS or CMOS technologies. Integrating the PROM 350 and the IDDC 346 onto the same integrated circuit is also more costly to manufacture than conventional MOS or CMOS technologies. Accordingly, additional board space will be required to accommodate the external PROM 350.

However, a distinct advantage over the first embodiment, is that a conventional graphics controller 126 can be used along with conventional connectors 130 and 136 and the cable 134. Thus, a manufacturer or user of a motherboard or computer system can simply replace an existing display unit 132 with one having the improvements of the second embodiment of the present invention. No alterations or modifications to the hardware of the computer system will be required. Indeed, utilization of the second embodiment is completely transparent to any standard computer system to which such a display system is coupled.

Preferred Embodiment

Figure 4:
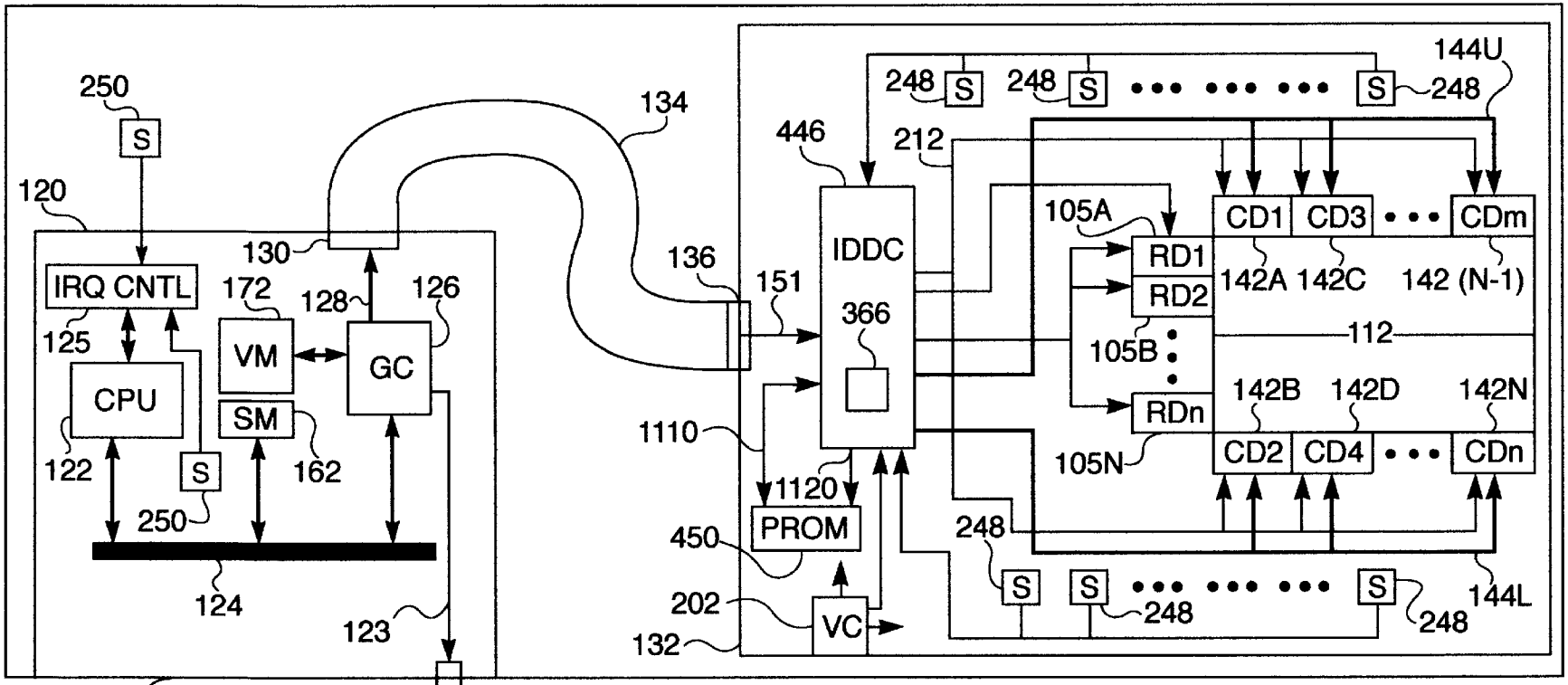
FIG. 4 is a block diagram of a preferred embodiment of the present invention including a serial PROM and an intelligent display driver controller.

FIG. 4 shows the block diagram of a third and preferred embodiment according to the present invention. As will be explained, an IDDC 446 of the preferred embodiment retrieves control sets from a serial PROM 450 by means of a serial protocol using only two signal lines—Serial Data Address (SDA) line 1120 and Serial Clock (SCL) line 1110. Because of this decreased number of signal lines, several advantages including a decrease in the space requirement on the panel bezel are realized.

The system of the preferred embodiment includes a motherboard 120 having a CPU 122 coupled to a address/data bus 124 which is also coupled to a graphics controller 126. The graphics controller 126 is coupled to a display bus 128, a first cable connector 130, a cable 134, a second cable connector 136 and to the IDDC 446 via the first display bus 151.

Figure 1:
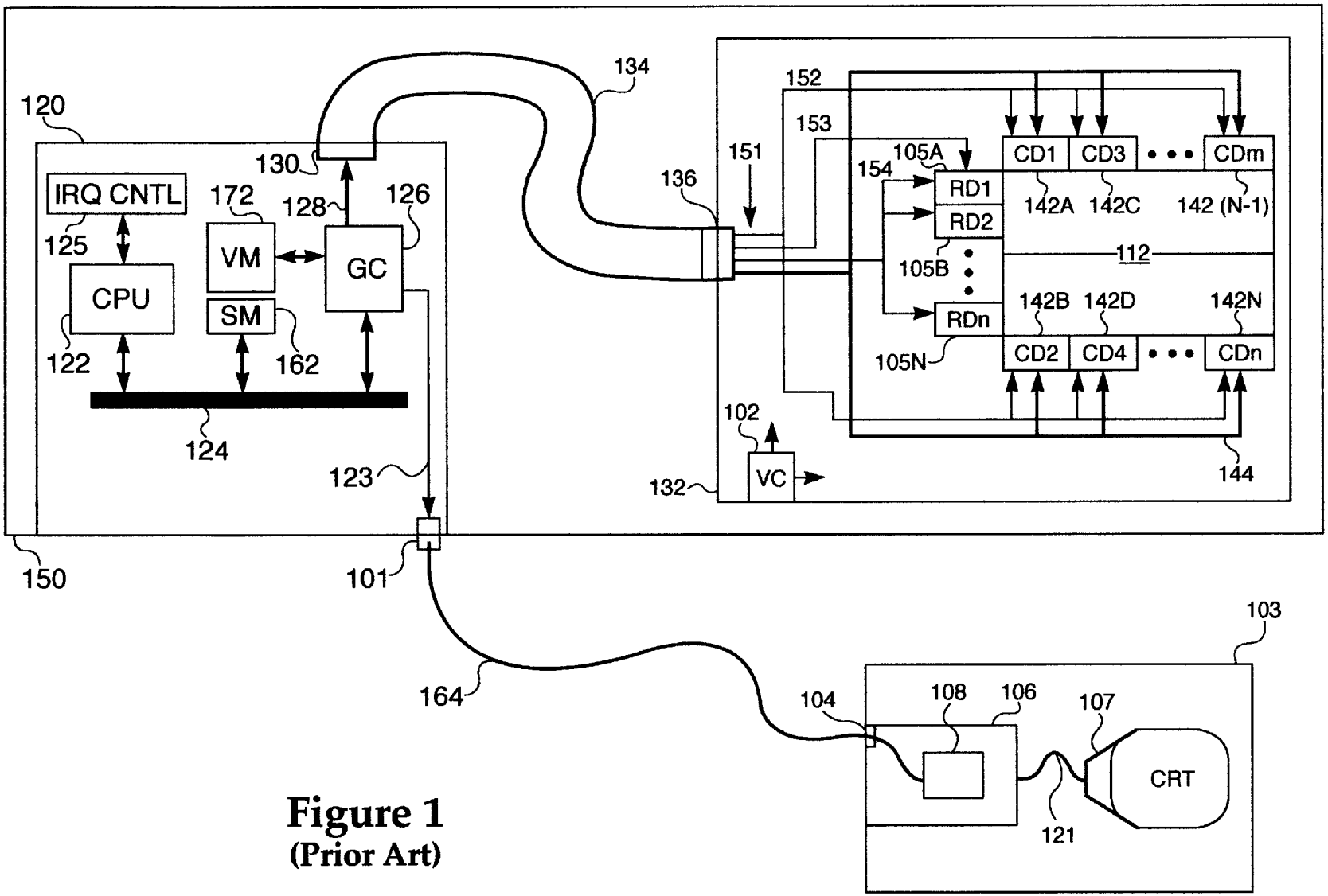
Figure 1 (Prior Art)
FIG. 1 is a block diagram of a conventional display system according to the prior art.

The IDDC 446 receives input data over the display bus 128, and controls the row 105X driver circuits and the column driver circuits 142X in a known manner, such as described with respect to FIG. 1, to display the image corresponding to the input data on a display screen 112. The display screen 112 described herein includes flat-panel displays such as typically used in portable computer systems, and conventional CRT display systems such as shown in FIG. 2. It will be appreciated by one skilled in the art that the present invention can be practiced in other types of display systems also without departing from the scope and spirit of the present invention.

The serial PROM 450 stores the control sets which may be retrieved by the IDDC 446. Exemplary serial PROMs have been implemented in at least SR24E64 Serial EEPROM chip available from SGS-Thomson Microelectronics, 55 old Bedford Road, Lincoln, Mass. 01773, and X24645 Serial EEPROM chip available from Xicor Inc, 1511 Buckeye Drive, Milpitas, Calif. 95035.

The serial PROM 450 of the preferred embodiment comprises an EEPROM with eight kilo-bytes of memory. Each control set in turn comprises two kilo-bytes of data. Therefore, the serial PROM 450 stores three control sets (referred as control set 0, control set 1, control set 2), in address spaces 2048–4095, 4096–6143, 6144–8192 respectively. In the preferred embodiment, the address space 0–2047 may be used to store information relating to registers (not shown in diagram) in IDDC 446 that are used to control the display of the input data.

One or more transducers and/or sensors 248 and 250, and integrated transducers sensors, such as within the panel voltage converter 202, are coupled to the IDDC 446. The sensors or integrated transducers/sensors measure or sense one or more parameters that can effect the image quality of display such as temperature, voltage linearity or intrinsic characteristics of the display screen 112. An indicia that is representative of the value of the measured or sensed parameter is provided to the IDDC 446 by the Sensors 248 or panel supply voltage 202.

Upon a predetermined change in the indicia of a parameter, the IDDC 446 determines a new control set based on a measured change in the parameter. The new control set is selected so as to compensate for any degradation in the display quality caused by the change in the measured condition.

The IDDC 446 retrieves the selected new control set from the serial PROM 450 by using only the signal lines 1110 and 1120 as explained below with reference to FIG. 5. The IDDC 446 uses a serial protocol to retrieve the control sets from the serial PROM 450. such as an extended $I^2C$ protocol. However, it will be apparent to one skilled in the art that the present invention can be practiced with other serial protocols without departing from the scope and spirit of the present invention. The IDDC 446 stores the retrieved control set into the control set storage 336 located in IDDC 446.

While retrieving the control set, the IDDC 446 provides the clock signal over the SCL line 1110 to the serial PROM 450 for synchronization. One bit of data is serially sent over the SDA line 1120 corresponding to each clock cycle. As will be clearer from the explanation with respect to FIG. 5, these bits of data can be either from the serial PROM 450 to the IDDC 446 or from IDDC 446 to serial PROM 450.

Figure 5:
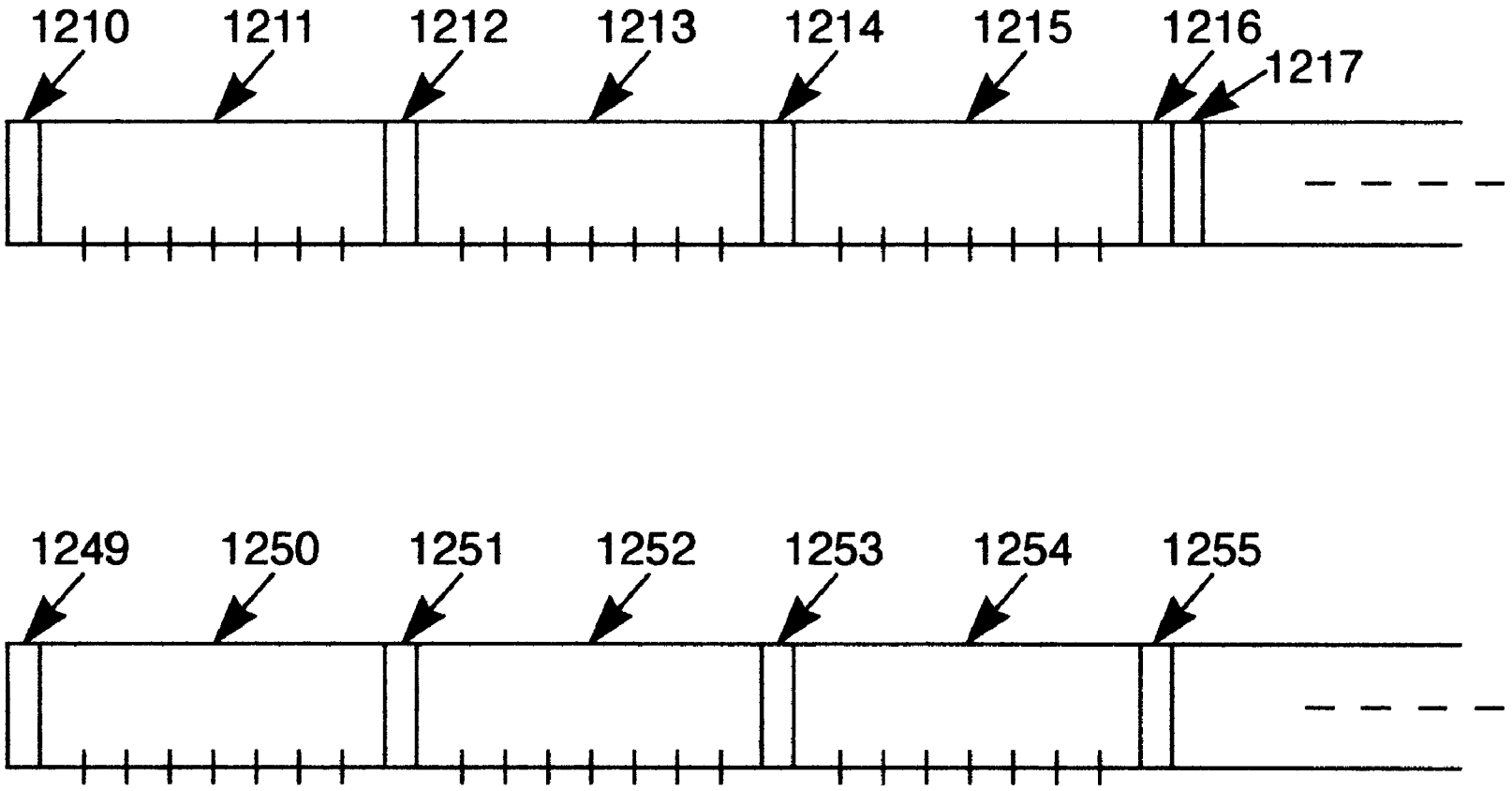
FIG. 5 illustrates the serial protocol communication between the intelligent display driver controller and the serial PROM to load a new control set from the serial PROM in the second alternate embodiment.

FIG. 5 illustrates the communication between the IDDC 446 and the serial PROM 450 as a part of the serial protocol to load a new control set from the serial PROM 450. This communication occurs after the IDDC 446 determines which of the control sets (0–2) stored in the serial PROM 450 is to be loaded based on the changes in the sensed parameters. As will be explained in more detail below, the loading (retrieval) process includes the steps of initiating the communication, indicating to the serial PROM 450 the starting address of the control set to be retrieved, and then retrieving the control set bit-by-bit. It will be further noted the receiver sends an acknowledgment bit after receiving each byte of the control set.

The IDDC 446 initiates communication with the serial PROM 450 by sending a start condition 1210 over the SCL line 1110. The serial PROM 450 monitors the SCL line 1110 during each clock cycle to determine whether the IDDC 446 is initiating communication. On detecting such start condition, the serial PROM 450 recognizes that the IDDC 446 will continue communication per the predetermined serial protocol.

After sending the start condition 1210, the IDDC 446 sends a control byte 1210. The control byte 1210 includes fields for device type (bits 0–3), device identification (bits 4–6), and operation type (bit 7). The device type field indicates the type of target device, i.e. the receiving device. In the present embodiment, the device type field is hard-coded to a value of '1010' to indicate that the serial PROM 450 of this embodiment is an Serial EEPROM.

The device identification field (bits 4–6) identifies one of the target devices of the type specified by the device type field if more than one device of that type is present. Here, the device identification field is always set to '000' since only one Serial EEPROM is employed in the present embodiment. It will be apparent to one of ordinary skill in the art that by providing the device type adn device identification fields the protocol offers the flexibility to include multiple types of devices, with several devices being within that type. However, since only one Serial EEPROM is used in the present embodiment, both the fields are set to a predetermined value.

The operation type field (bit 7) specifies whether the intended operation is a read operation or a write operation. A value of 0 indicates that the operation is a write operation, and 1 indicates that it is a read operation. Here (i.e. when sending the starting address in subsequent bytes), the operation type field is set to 0 causing the serial PROM 450 to interpret the subsequent bytes as the starting address of control set to be retrieved.

After sending the control byte 1211, the IDDC 446 transitions from a 'send' mode to a 'receive' mode. In the receive mode, the serial PROM 450 sends an acknowledgment bit 1212 over the SDA line 1120 to indicate successful reception of a byte (eight bits of control byte here). It will be apparent from the following explanation that an acknowledgment bit is sent by the receiver (either the IDDC 446 or the serial PROM 450 as the case may be) to the sender after successful reception of each byte of data. The IDDC 446 continues to supply the clock over the SCL line 1110 for all the transmissions including the acknowledgment bit irrespective of who the sender is.

After receiving the acknowledgment bit 1212, the IDDC 446 transitions back into the send mode, and sends the starting address of the control set. For example, to retrieve control set 1, the IDDC sends a starting address of 4096. Similarly, to retrieve control set 0 or 2, the IDDC 446 sends a starting address of 2048 or 6144 respectively. Each of the starting addresses of the present embodiment comprise two bytes—a most significant byte and a least significant byte.

The IDDC 446 first sends the most significant byte 1213 of the starting address, waits for an acknowledgment bit 1214, and sends the least significant byte 1215 of the starting address. The serial PROM 450 sends another acknowledgment bit 1216 to indicate successful reception of the least significant byte 1215 of the starting address. The serial PROM 450 stores the starting address in a pointer that points to an address of the serial PROM. As has been explained, the serial PROM stores the control sets, each with a predetermined starting address. Therefore, the pointer in the serial PROM 450 points to the first byte of the control set that is to be loaded.

After receiving the acknowledgment bit 1215, the IDDC 446 sends a stop condition 1217 to indicate the end of the transmission. The reception of the stop condition allows the serial PROM 450 to go into a power-saver mode if there is no requirement for it to operate in the near future, thereby conserving energy. However, irrespective of whether the serial PROM 450 is in the power-saver mode or not, the serial PROM 450 continues to monitor for a start condition on the SDA line 1120. On detecting such start condition, the serial PROM 450 monitors the SDA line 1120 for the control byte.

To begin retrieving the control set, the IDDC 446 sends a start condition 1249, and then a control byte 1250. The device type field and the device identification fields are set to '1010' and '000' respectively as explained above with respect to the control byte 1211. The operation type of control byte 1250 bit is set to 1 to indicate a read operation. The serial PROM 450 sends an acknowledgment bit 1251 to indicate successful reception of the control byte 1250.

After sending the acknowledgment bit 1251, the serial PROM 450 sends one bit of the control set corresponding to each clock cycle received on the SCL line 1110. For this purpose, the serial PROM 450 retrieves the byte corresponding to the address pointed by the pointer in the Serial EEPROM. Since the serial PROM 450 stored the starting address received (bytes 1213, 1215) in this pointer, the first byte of the control set is retrieved.

The serial PROM 450 sends the first byte 1250 of the control set, one bit per clock cycle over the SDA line 1120. The serial PROM 450 receives an acknowledgment bit 1251 from the IDDC 446 indicating successful reception of the first byte 1250.

After sending the first byte of the control set, the serial PROM 450 increments the pointer so as to point to the next byte of the control set that needs to be transmitted. The serial PROM 450 retrieves that next byte, and transmits that byte also one-bit per clock cycle over the SDA line 1120. The serial PROM 450 continues to transmit consecutive bytes as long as the IDDC 446 sends a clock signal over the SCL line 1110. Therefore, the IDDC 446 continues to send a clock signal until receiving all the bytes of the control set (i.e. 2024 bytes). The transmission of only the first two bytes 1252, 1254 is shown in FIG. 5.

It will be further noted that the IDDC 446 sends the write command using the communication shown in 1210–1217 to set the starting address of the control set stored in the serial PROM 450. However, if the IDDC 446 'knows' that the starting address is correctly set (for example, due to a prior retrieval) in the serial PROM 450, the IDDC 446 can begin the retrieval process (i.e. 1249 through 1254) without setting the starting address (i.e. 1210 through 1216).

Figure 6A:
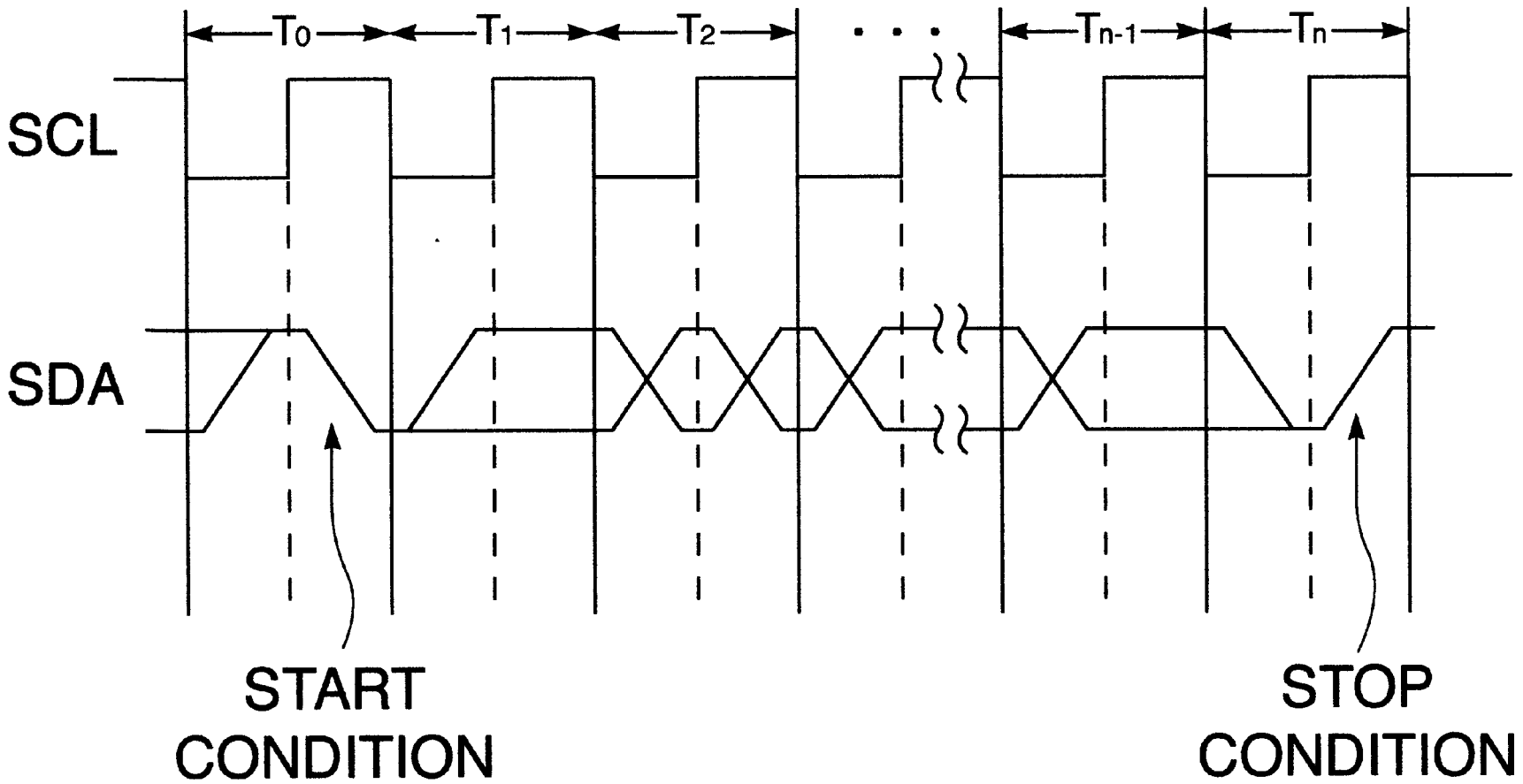
FIGS. 6*a* and 6*b* illustrate the signaling scheme in the communication between the intelligent display driver controller and the serial PROM in the preferred embodiment.

FIG. 6*a* illustrates the signaling scheme for the start condition, and the stop condition used in the above communication. The start condition is illustrated with reference to the signals during clock cycle T0. A transition from the high signal level to a low signal level on the SDA line 1120 when the clock signal on the SCL line 1110 is high, indicates a start condition. Therefore, during the high signal level of clock cycle T0 of FIG. 6A, the transition from high signal level to low signal level on the SDA line 1120 is interpreted as a start condition. As explained with reference to FIG. 5, the IDDC 446 sends the start condition to the serial PROM 450 to initiate communication.

The stop condition is illustrated with reference to the signals during clock cycle Tn. A transition from the low signal level to a high signal level on the SDA line 1120 when the clock signal on the SCL line 1110 is high is used as a stop condition. Therefore, during the high signal level of clock cycle Tn, the transition from low signal level to high signal level on the SDA line 1120 is interpreted as a stop condition. As explained with reference to FIG. 5, the IDDC 446 sends the stop condition to the serial PROM 450 to terminate communication. The IDDC 446 sends the start condition again to initiate communication with the serial PROM 450.

Figure 6B:
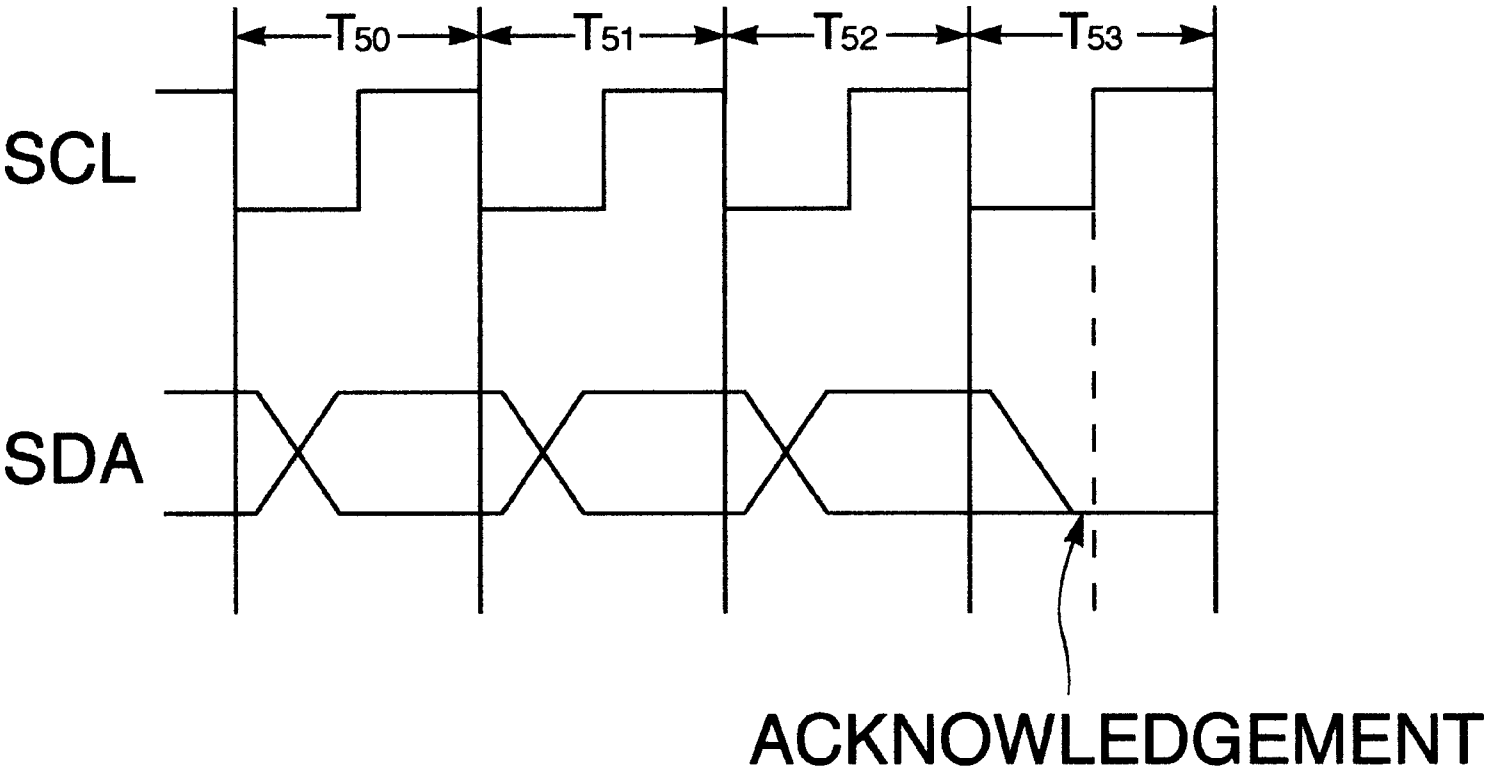

FIG. 6*b* illustrates the signaling scheme for the acknowledgment bit. As explained with reference to FIG. 5, the receiver (either the IDDC 446 or the serial PROM 450) sends an acknowledgment signal upon receiving a series of eight bits. The acknowledgment signal serves as a byte demarker in the communication. An active low signal level on the SDA line 1120 on the rising edge of the clock signal on the SCL line 1110 is interpreted as an acknowledgment. Hence, the low signal level on the SDA line 1120 during the rising edge of the clock cycle T53 indicates the acknowledgment bit.

Therefore, the IDDC 446 retrieves the new control set using only the two signal lines SDA 1120 and SLC 1110. In contrast, the second alternative embodiment employing a parallel bus to transfer the starting address and the data may require twenty-three pins (thirteen for address, eight for data, and two control pins). The decreased number of pins in both the IDDC 446 and the serial PROM 450 results in decreased manufacturing cost of the chips. In addition, the IDDC 446 and serial PROM 450 are smaller in size due to the decreased number of pins, and therefore consume less space on the panel bezel where they are typically mounted. It will be appreciated that space savings on the panel bezel is an important factor at least in the portable computer applications because several other components share the limited space available on the panel bezel.

Furthermore, the routing of the connections between IDDC 446 and serial PROM 450 is simplified because of the decreased number of pins. This results in further decrease in space requirement on the panel bezel of the display system 132. However, one disadvantage with the serial protocols is that the retrieval process takes more time than that using parallel bus of the second embodiment.

Once the transfer of the new control set is complete, the display system 132 controls the column-drivers and row drivers according to the new control set to display additional input data received from the graphic controller 26. Because of the new control set used, possible deterioration in the image quality on the display screen 112 is avoided, thereby maintaining a predetermined image quality.

The present invention has been described relative to a preferred embodiment and several alternate embodiments. It will be apparent to one of ordinary skill in the art after reading the teachings of this patent document that further modifications can be made without departing from the spirit and scope of the invention as defined in the claims appended hereto.

What is claimed is:

1. A display system for maintaining a predetermined image quality, the display system comprising:

a display screen for displaying an image corresponding to an input data;

a sensor for measuring a parameter having a predetermined effect upon image quality on the display screen;

a first memory to store a plurality of control sets, each control set comprising a set of data representing a plurality of analog voltage levels, each corresponding to a digital input data value so as to be output as analog display driving signals, each control set corresponding to one of a predetermined values of the parameter; and a display driver controller receiving the input data and a control set, and generating display driving signals for controlling a display of the image of the input data on the display screen based on the received control set, the display driver controller retrieving a new control set from the first memory using a serial protocol in response to a change in the parameter, and displaying the image of the input data based on the new control set so as to maintain the predetermined image quality on the display screen.

2. The display system of claim 1 wherein the first memory includes an addressable memory space with each memory address comprising a first number of bits, each control set being stored starting at a predetermined starting address.

3. The display system of claim 2 wherein the display driver controller determines the new control set based on the change in the parameter, the display driver controller sending the starting address of the new control set to the first memory to retrieve the new control set.

4. The display system of claim 3 wherein the display driver controller further comprises a second memory for storing the new control set.

5. The display system of claim 1 wherein the serial protocol is an extended $I^2C$ protocol.

6. The display system according to claim 1 wherein the first memory is a nonvolatile memory.

7. The display system according to claim 6 wherein the nonvolatile memory is a ROM.

8. The display system according to claim 6 wherein the nonvolatile memory is a PROM.

9. The display system according to claim 6 wherein the nonvolatile memory is an EPROM.

10. The display system according to claim 6 wherein the nonvolatile memory is an EEPROM.

11. A display system for use in a multimedia system, the display system maintaining a predetermined image quality, the display system comprising:

a display screen for displaying an image corresponding to an input data;

a sensor for measuring a parameter having predetermined effect upon image quality;

a first memory to store a plurality of control sets, each control set comprising a set of data representing a plurality of analog voltage levels, each corresponding to a digital input data value so as to be output as analog display driving signals, each control set corresponding to one of a predetermined values of the parameter; and a display driver controller coupled to the first memory by a bus comprising of an SDA signal line and an SCL signal line, the display driver controller receiving the input data and a control set, and generating display driving signals for controlling a display of the image of the input data on the display screen based on the received control sets, the display driver controller retrieving a new control set from the first memory over the bus in response to a change in the parameter, and displaying the image of the input data based on the new control set so as to maintain the predetermined image quality on the display screen.

12. The display system of claim 11 wherein the display driver controller provides a clock signal over the SCL signal line to retrieve the new control set.

13. The display system of claim 11 wherein the first memory includes an addressable memory space with each memory address comprising a first number of bits, each control set being stored starting at a predetermined starting address.

14. The display system of claim 13 wherein the display driver controller determines the new control set based on the change in the parameter, the display driver controller sending the starting address of the new control set to the first memory over the SDA signal line to retrieve the new control set.

15. A circuit architecture for maintaining a predetermined image quality in a display system of a computer system, the circuit architecture comprising:

a first memory to store a plurality of control sets, each control set comprising a set of data representing a plurality of analog voltage levels, each corresponding to a digital input data value so as to be output as analog display driving signals, each control set corresponding to one of a predetermined values of the parameter;

a sensor circuit for measuring a parameter having a predetermined effect upon image quality; and a display driver controller receiving an input data and a control set, and generating display driving signals for controlling a display of the image of the input data based on the received control set, the display driver controller retrieving a new control set from the first memory using a serial protocol in response to a change in the parameter, and displaying the image of the input data based on the new control set so as to maintain the predetermined image quality.

16. The circuit architecture of claim 15 further comprising a second memory for storing one of the control sets based on which the display driver controls the display of the image, the display driver storing the new control set in the second memory after retrieving the new control set.

17. The circuit architecture of claim 16 wherein the first memory is coupled to the second memory by a bus comprising of an SDA signal line and an SCL signal line.

18. The circuit architecture of claim 16 wherein the first memory includes an addressable memory space with each memory address comprising a first number of bits, each control set being stored starting at a predetermined starting address.

19. The circuit architecture of claim 18 wherein the display driver controller determines the new control set based on the change in the parameter, the display driver controller sending the starting address of the new control set to the first memory to retrieve the new control set.

20. The circuit architecture of claim 15 wherein the serial protocol is an extended $I^2C$ protocol.

21. A circuit architecture for maintaining a predetermined image quality in a display system of a computer system, the circuit architecture comprising:

a first memory comprising a set of addressable memory locations for storing a plurality of control sets, each address of the memory location comprising a first number of bits, each control set being stored from a predetermined starting address, each control set of data representing a plurality of analog voltage levels, each corresponding to a digital input data value so as to be output as analog display driving signals, each control set corresponding to one of a predetermined values of the parameter;

a sensor circuit for measuring a parameter having a predetermined effect upon image quality; and a display driver controller circuit receiving an input data and controlling display of an image of the input data based on one of the control sets, the display driver determining a new control set in the first memory in response to a change in the parameter, the display driver sending a first subset of the first number of bits of the starting address of the new control set during one clock cycle and a second subset of the first number of bits of the starting address of the new control set during a subsequent clock cycle to retrieve the new control set from the first memory, the display driver displaying the image of the input data based on the new control set so as to maintain the presetermined image quality.

22. A computer system with a display system maintaining a predetermined image quality, the computer system comprising:

a graphics controller for sending an input data corresponding to an image;

a display screen for displaying the image;

a sensor for measuring a parameter having a predetermined effect upon image quality on the display screen;

a first memory to store a plurality of control sets, each control set comprising a set of data representing a plurality of analog voltage levels, each corresponding to a digital input data value so as to be output as analog display driving signals, each control set corresponding to one of a predetermined values of the parameter; and a display driver controller circuit receiving the input data and controlling a display of the image based on one of the control sets, the display driver determining a new control set in the first memory in response to a change in the parameter, the display driver sending a first subset of the first number of bits of the starting address of the new control set during one clock cycle and a second subset of the first number of bits of the starting address of the new control set during a subsequent clock cycle to retrieve the new control set from the first memory, the display driver displaying the image of the input data based on the new control set so as to maintain the predetermined image quality.

23. The circuit architecture of claim 22 further comprising a second memory for storing one of the control sets based on which the display driver controls the display of the image, the display driver storing the new control set in the second memory after retrieving the new control set.

24. A method of maintaining a predetermined image quality in a display system comprising the steps of:

providing a first memory for storing a plurality of control sets, each control set comprising a set of data representing a plurality of analog voltage levels, each corresponding to a digital input data value so as to be output as analog display driving signals, each control set corresponding to one of a predetermined values of the parameter; and displaying an image corresponding to an input data on the display system based on a control set stored in a second memory;

measuring a parameter which has an effect on the image quality of the display system;

selecting a new control set in the plurality of control sets based on a change in the parameter;

retrieving the new control set from the first memory using a serial protocol;

storing the new control set in the second memory; and displaying the input data on the display system based on the new control set stored in the second memory so as to maintain the predetermined image quality in the display system.

25. The method of claim 24 wherein the step of storing comprises replacing the control set in the second memory with the new control set.

26. An image quality control circuit for use in a display system including a display screen for displaying an image corresponding to an input data wherein a quality of the image varies in accordance with a parameter, a display control circuit coupled for receiving the input data and for controlling a display of the image on the screen, a memory coupled to provide a plurality of control sets to the display control circuit, wherein each control set comprises a set of data representing a plurality of analog voltage levels, each corresponding to a digital input data value so as to be output as analog display driving signals, each control set corresponding to one of a predetermined values of the parameter, a sensor for measuring the parameter, the image quality control circuit comprising:

a first circuit coupled to the sensor for receiving a signal representative of a measured parameter value, and a second circuit coupled to the memory and the display control circuit for selecting an appropriate control set using a serial protocol from the memory in response to a change in the measured parameter value for maintaining the quality of the image.

27. The image quality control circuit according to claim 26 wherein the image quality control circuit comprises an integrated circuit.

28. The image quality control circuit according to claim 27 wherein the display control circuit is incorporated into the integrated circuit.

* * * * *